US006901872B1

(12) United States Patent
Battle et al.

(10) Patent No.: US 6,901,872 B1
(45) Date of Patent: Jun. 7, 2005

(54) POWERED SURFBOARD AND POWERED SKATEBOARD

(76) Inventors: Darwin R. Battle, 1812 Blair Ave., St. Paul, MN (US) 55104; Guama L. Battle, 1812 Blair Ave., St. Paul, MN (US) 55104

( * ) Notice: Subject to any disclaimer, the term of this patent is extended or adjusted under 35 U.S.C. 154(b) by 44 days.

(21) Appl. No.: 10/445,363

(22) Filed: May 27, 2003

(51) Int. Cl.[7] ..... B63B 35/73
(52) U.S. Cl. ..... 114/55.56; 441/74
(58) Field of Search ..... 114/55.5, 55.51–55.58; 440/38; 441/74

(56) References Cited

U.S. PATENT DOCUMENTS 2,901,757 A * 9/1959 Remington ..... 440/85
3,262,413 A * 7/1966 Douglas et al. ..... 440/46
3,324,822 A * 6/1967 Carter, III ..... 440/38
4,020,782 A * 5/1977 Gleason ..... 114/55.58
4,170,188 A 10/1979 Jamison, Jr.
4,274,357 A * 6/1981 Dawson ..... 114/55.51
5,017,166 A 5/1991 Chang
5,294,187 A 3/1994 Racicot
5,316,508 A 5/1994 Landucci
6,142,840 A 11/2000 Efthymiou
6,192,817 B1 * 2/2001 Dec et al. ..... 114/55.56
6,409,560 B1 6/2002 Austin
6,702,634 B2 * 3/2004 Jung ..... 441/74

* cited by examiner

*Primary Examiner*—Bryan Fischmann
(74) *Attorney, Agent, or Firm*—Donald R. Schoonover

(57) ABSTRACT

A surfboard vehicle and a skateboard vehicle are each powered by a motor unit that is located in the rear of the vehicle and is located so the vehicle is balanced sufficiently to be used in competition and/or at high speeds.

1 Claim, 1 Drawing Sheet

POWERED SURFBOARD AND POWERED SKATEBOARD

BACKGROUND OF THE INVENTION

1. Field of the Invention

The present invention relates to the general art of powered vehicles, and to the particular field of surfboards and skateboards.

2. Discussion of the Related Art

Surfboarding and skateboarding require common skills of balance and agility. The surfboard is powered by movement of water supporting the surfboard and the skateboard is powered by the rider. In both cases, the rider cannot fully concentrate on balance and agility because he or she has to direct a significant amount of concentration on the powering of the vehicle.

Therefore, there is a need for a surfboard/skateboard vehicle that does not require a rider to divert a significant amount of attention to powering the vehicle.

While the art does contain several examples of powered surfboards, the power units associated with these surfboards are not positioned to enhance the balance of the vehicle. Such powered vehicles are not amenable to racing or competition because they are not properly balanced.

Therefore, there is a need for a surfboard/skateboard vehicle that is balanced so it can be used in competition and/or at high speeds.

PRINCIPAL OBJECTS OF THE INVENTION

It is a main object of the present invention to provide a surfboard/skateboard vehicle that does not require a rider to divert a significant amount of attention to powering the vehicle.

It is another object of the present invention to provide a surfboard/skateboard vehicle that is balanced so it can be used in competition and/or at high speeds.

SUMMARY OF THE INVENTION

These, and other, objects are achieved by a vehicle that is powered by a motor that is located on a body member of the vehicle in a position that balances the vehicle. The vehicle can be either a surfboard or a skateboard. The body member of the vehicle is also shaped so the motor unit of the vehicle adds to the balance and control of the vehicle when the vehicle is operated at high speeds or under competition conditions.

BRIEF DESCRIPTION OF THE DRAWING FIGURES

DETAILED DESCRIPTION OF THE PREFERRED EMBODIMENT

Other objects, features and advantages of the invention will become apparent from a consideration of the following detailed description and the accompanying drawings.

Figure 2:
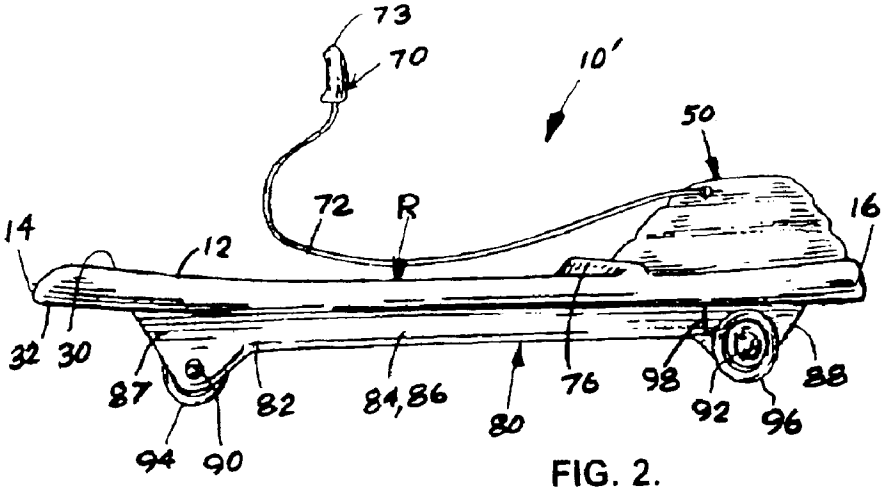
FIG. 2 is a perspective view of a powered skateboard embodying the present invention.
Figure 1:
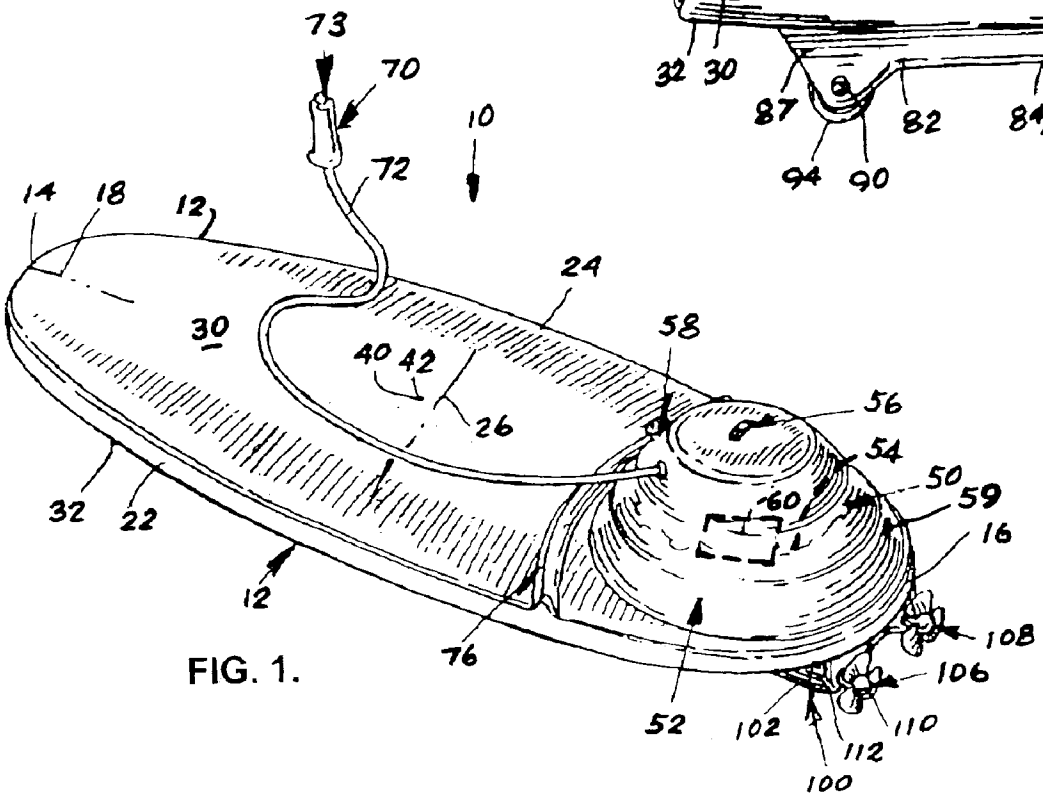
FIG. 1 is a perspective view of a powered surfboard embodying the present invention.

Referring to FIGS. 1 and 2, it can be seen that the present invention is embodied in a water vehicle 10, such as a surfboard, shown in FIG. 1 or a land vehicle 10', such as a skateboard, shown in FIG. 2. Both of the vehicles, 10 and 10', have certain components which are identical to each other. Therefore, the initial description will be presented for these common components and reference can be made to either FIG. 1 or FIG. 2. The components that are different for the water vehicle 10 from the components associated with the land vehicle 10' will then be discussed. Therefore, it will be understood that, while the following discussion initially focuses on FIG. 1, the common components will be found in FIG. 2 as well.

As shown in FIG. 1, vehicle 10, like vehicle 10', comprises a body member 12 which has a front end 14, a rear end 16' and a longitudinal centerline 18 which extends between the front end 14 and the rear end 16 of the body member 12. The body member 12 also includes a first side 22, a second side 24, and a transverse centerline 26 which extends between the first side 22 and the second side 24.

A first surface 30 forms a top surface 30 when the body member 12 is in use and a second surface 32 forms a bottom surface 32 when the body member 12 is in use.

The body member 12 is oblong in shape and the longitudinal centerline 18 is longer than the transverse centerline 26 whereby the longitudinal centerline 18 forms the major axis and the transverse centerline 26 forms the minor axis of the oblong shaped body member 12. The body member 12 can be formed of any material that is suitable for such vehicles, including plastics-type materials, composite-type materials or the like. Since the vehicle 10, 10' may be used at high speeds, the materials are selected accordingly.

A longitudinal center portion 40 is located on the longitudinal centerline 18 midway between the front end 14 of the body member 12 and the rear end 16 of the body member 12, and a transverse center portion 42 is located on the transverse centerline 26 midway between the first side 22 of the body member 12 and the second side 24 of the body member 12. As shown in FIG. 1, the longitudinal center portion 40 is coincident with the transverse center portion 42.

The body member 12 is curved between the front end 14 and the rear end 16 to be concave when viewed from the top surface 30 and to have a radius of curvature R (see FIG. 2).

A motor unit 50 has a housing 52 mounted on the top surface 30 of the body member 12 immediately adjacent to the rear end 16 of the body member 12. A motor 54 is located in the housing 52 of the motor unit 50. The motor 54 can be any form suitable to the land vehicle 10' or the water vehicle 10. The motor 54 can be an internal combustion engine, or, in the form shown in FIG. 1, an electric motor. The location of the motor unit 50 on the rear end 16 of the body member 12 co-operates with the curvature of the body member 12 to provide proper weighting to the body member as the body member 12 changes its position, especially a surfboard in the water, when the body member 12 is operated at high speeds. The location of the motor unit 50 provides stability to the body member 12 to permit the rider to have great control of the body member 12 when the body member 12 is executing complicated maneuvers, especially at high speeds, as will occur during competitions.

An on/off switch 56 is located on the housing 52 of the motor unit 50, and a key lock 58 is connected to the on/off switch 56 to disable the on/off switch 56 when the key lock 58 is in an "off" position. A "motor on" indicator light 59 is located on the housing 52 of the motor unit 50.

A power source 60, such as a battery pack, is located in the housing 52 of the motor unit 50 and is connected to the motor 54 via the on/off switch 56 when the on/off switch 56 is in an "on" condition.

A hand-held control unit 70 is associated with the motor unit 50 and has an electrical connection 72 to the motor 54 and a plurality of control buttons, such as on/off button 73 thereon. Other control buttons can control the speed of the motor 54, the direction of the vehicle 10, 10, and the like.

A motor barrier 76 is positioned on the top surface 30 of the body member 12 between the housing 52 and the motor unit 50 and the transverse center portion 42 of the body member 12.

Referring to FIG. 2, the land vehicle version 10' of the vehicle embodying the present invention includes a chassis unit 80 located on the bottom surface 32 of the body member 12. The chassis unit 80 has a wheel mount frame 82 which includes two rails 84 and 86 which are mounted on the bottom surface 32 of the body member 12. The two rails 84, 86 are identical and are co-extensive. Thus, while only one rail is visible in FIG. 2, it will be understood that the other rail is identical to the rail visible in FIG. 2. Each rail of the two rails 84, 86 has a forward end 87 located near the front end 14 of the body member 12 and a rear end 88 located near the rear end 16 of the body member 12. The rails 84, 86 extend in the direction of the longitudinal centerline 18, and the longitudinal centerline 18 of the body member 12 is located midway between the two rails 84, 86.

A front axle 90 extends between the two rails 84, 86 in the direction of the transverse centerline 26 of the body member 12. The front axle 90 is located near the forward end 87 of each rail of the two rails 84, 86.

A rear axle 92 extends between the two rails 84, 86 in the direction of the transverse centerline 26 of the body member 12. The rear axle 92 is located near the rear end 88 of each rail of the two rails 84, 86.

Two front wheels, such as front wheel 94, are mounted on the front axle 90, and two rear wheels, such as rear wheel 96, are mounted on the rear axle 92.

A power connection 98, such as a universal joint or like element familiar to those skilled in the art of vehicles, is located between the motor 54 and the rear wheels 96 to drive the rear wheels 96 when the motor 54 is activated.

Vehicle 10' is used in the manner of a skateboard.

Referring to FIG. 1 it can be seen that the present invention is also embodied in water vehicle 10. Water vehicle 10 has elements which are identical to the elements just described.

Vehicle 10 includes a propeller unit 100 located on the bottom surface 32 of the body member 12. Propeller unit 100 includes a housing 102 on the bottom surface 32 of the body member 12 immediately adjacent to the rear end 16 of the body member 12. The location of the housing for the propeller unit 110, like the location of the housing 52 for the chassis of the land vehicle 10', co-operates with the location and weight of the motor housing of the vehicle to is add balance to the vehicle, especially during high speed and/or complicated maneuvers.

Two propellers 106 and 108 are located on the housing 102 of the propeller unit 100. Each propeller 106, 108 is located outside of the housing 102 of the propeller unit 100 and each propeller 106, 108 includes a drive shaft, such as drive shaft 110, which extends through the housing 102 of the propeller unit 100. The longitudinal centerline 18 of the body member 12 is positioned between the two propellers 106, 108 of the propeller unit 100.

A power connection 112 is located in the housing 102 of the propeller unit 100 and connects the shaft 110 of each propeller 106, 108 to the motor of the motor unit to rotate the shafts of the propellers-when the motor is activated. The power connection 112 is familiar to those skilled in the art. Since the particular form of power connection 112 does riot form part of the invention and any suitable power connection can be used in either vehicle 10 or vehicle 10', the details of such power connections will not be presented.

Both vehicles can include safety straps and the like if desired.

It is understood that while certain forms of the present invention have been illustrated and described herein, it is not to be limited to the specific forms or arrangements of parts described and shown.

What is claimed and desired to be covered by Letters Patent is:

1. A water vehicle comprising:

a) a body member having
  (1) a front end,
  (2) a rear end,
  (3) a longitudinal centerline extending between the front end and the rear end of said body member,
  (4) a first side,
  (5) a second side,
  (6) a transverse centerline extending between the first side and the second side,
  (7) a first surface that is a top surface when said body member is in use,
  (8) a second surface that is a bottom surface when said body member is in use,
  (9) said body member being oblong in shape with the longitudinal centerline being longer than the transverse centerline,
  (10) a longitudinal center portion located on the longitudinal centerline midway between the front end of said body member and the rear end of said body member, and
  (11) a transverse center portion located on the transverse centerline midway between the first side of said body member and the second side of said body member;

b) said body member being curved between the front end and the rear end to be concave when viewed from the top surface;

c) a motor unit having
  (1) a housing mounted on the top surface of said body member immediately adjacent to the rear end of said body member,
  (2) a motor located in the housing of said motor unit,
  (3) an on/off switch located on the housing of said motor unit,
  (4) a key lock connected to the on/off switch to disable the on/off switch when the key lock is in an "off" position,
  (5) a "motor on" indicator light on the housing of said housing unit, and
  (6) a power source in the housing of said motor unit and connected to the motor via the on/off switch when the on/off switch is in an "on" condition;

d) a hand-held control unit having
  (1) an electrical connection to the motor, and
  (2) control buttons;

e) a motor barrier positioned on the top surface of said body member between the housing and said motor unit and the longitudinal center portion of said body member; and f) a propeller unit located on the bottom surface of said body and having (1) a housing on the bottom surface of said body member immediately adjacent to the rear end of said body member, (2) two propellers on the housing of said propeller unit, each propeller being located outside of the housing of said propeller unit and each propeller including a drive shaft extending through the housing of said propeller unit, (3) the longitudinal centerline of said body member being positioned between the two propellers of said propeller unit, and (4) a power connection in the housing of said propeller unit connecting the shaft of each propeller to the motor of said motor unit to rotate the shafts of the propellers when the motor is activated.

* * * * *